US006935296B2

(12) United States Patent
Abele et al.

(10) Patent No.: US 6,935,296 B2
(45) Date of Patent: Aug. 30, 2005

(54) METHOD OF PRODUCING A GAS SHUTTLE VALVE OF AN INTERNAL COMBUSTION ENGINE

(75) Inventors: Marcus Abele, Gerlingen (DE); Martin Lechner, Stuttgart (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 3 days.

(21) Appl. No.: 10/323,068

(22) Filed: Dec. 19, 2002

(65) Prior Publication Data

US 2003/0121488 A1 Jul. 3, 2003

(30) Foreign Application Priority Data

Dec. 27, 2001 (DE) ..... 101 63 769

(51) Int. Cl.[7] ..... F02N 3/00
(52) U.S. Cl. ..... 123/188.3; 251/337
(58) Field of Search ..... 123/188.3; 251/337; 29/888.46

(56) References Cited

U.S. PATENT DOCUMENTS 2,119,042 A * 5/1938 Charlton ..... 123/188.3
4,834,036 A 5/1989 Nishiyama et al.
6,354,258 B1 3/2002 Abele et al.
6,502,804 B1 * 1/2003 Schwegler et al. ..... 251/129.1

FOREIGN PATENT DOCUMENTS

| | | |
|---|---|---|
| FR | 2283310 | 8/1975 |
| GB | 1439230 | 8/1973 |
| JP | 57210112 | 12/1982 |

OTHER PUBLICATIONS von Kaenel, et al (2000) "A New Concept for Steel–Composite Lightweight Valves", *Society of Automotive Engineers, Inc.*, Publication 2000–01–0906.

* cited by examiner

*Primary Examiner*—Willis R. Wolfe
*Assistant Examiner*—Katrina B. Harris
(74) *Attorney, Agent, or Firm*—Collard & Roe, P.C.

(57) ABSTRACT

A gas shuttle valve is for an internal combustion engine, in which a valve plate, as a sealing element, a tubular valve shaft, as a guide element, and a thrust part, which seals the end of the valve shaft opposite to the valve cone, as a stop for a valve operating element having a support for a typical valve spring, are welded to one another. This production method is distinguished by a precisely fitted assembling of these parts to a predetermined length measure, which precedes the permanent bonding of the valve shaft and thrust part.

11 Claims, 1 Drawing Sheet

METHOD OF PRODUCING A GAS SHUTTLE VALVE OF AN INTERNAL COMBUSTION ENGINE

Figure 1:
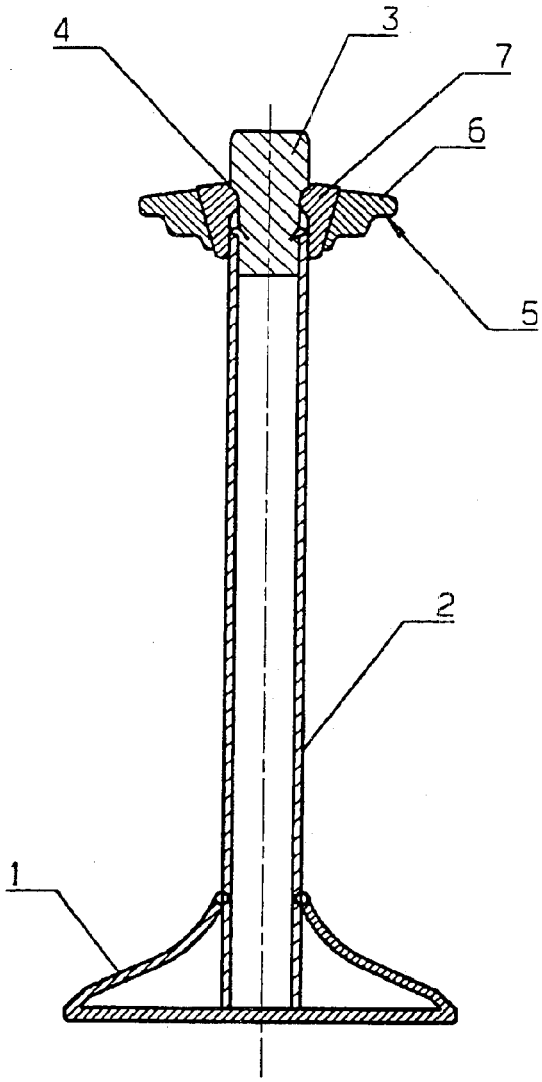

The present invention relates to a method of producing a gas shuttle valve of an internal combustion engine according to the preamble of Claim 1 and a gas shuttle valve produced according to this method.

Gas shuttle valves according to the species are known in one embodiment as lightweight valves. In these known valves, the individual parts from which they are made are first welded to one another and then finishing is performed, in particular in regard to the length of these valves. Lightweight valves produced in this way are known, for example, from publication 2000-01-0906 of the Society of Automotive Engineers, Inc.: "A New Concept For Steel-Composite Lightweight Valves" by Andreas von Kaenel, Peter Grahle, and Marcus Abele of Mahle Ventiltrieb GmbH.

The present invention is concerned with the problem of simplifying the production of such lightweight valves according to the species, in order to thus reduce the required production costs.

This object is primarily achieved for a method according to the species by the production steps according to the characterizing features of Claim 1.

Advantageous embodiments of this method are the object of the method subclaims.

The last claim, which is directed to a gas shuttle valve produced according to the method according to the present invention, discloses a particularly advantageous embodiment of a gas shuttle valve according to the species.

The present invention is primarily based on the general idea of assembling a lightweight valve according to the species from individual parts so it is precisely fitted to a predetermined length measure and welding these parts to one another in this state. In this case, all and/or at least as much as possible of the necessary processing is to be performed before the assembling, so that in the ideal case, after the assembling and welding of already completely finished individual parts, no further processing must be performed.

An advantageous exemplary embodiment of the present invention is illustrated in the drawing.

Figure 2:
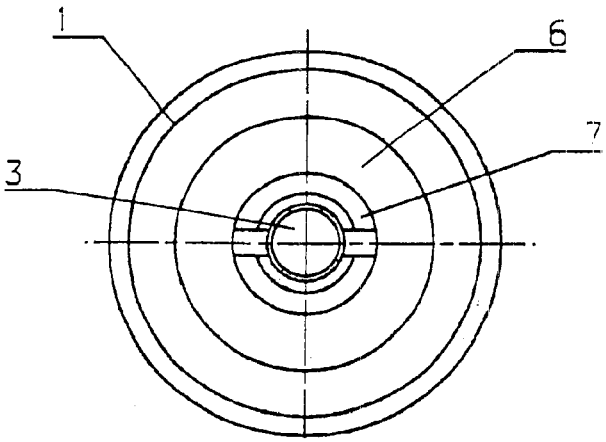

FIG. 1 shows a longitudinal section through a lightweight gas shuttle valve having a valve spring support in place, FIG. 2 shows a top view of the gas shuttle valve from FIG. 1.

A gas shuttle valve implemented as a lightweight valve comprises a hollow valve plate 1, a tubular valve shaft 2, and a thrust part 3, which seals the end of valve shaft 2 lying opposite valve plate 1. Valve shaft 2 is connected to valve plate 1 and to thrust part 3 via a sliding fit in each case. The coordination between valve plate 1 and valve shaft 2 is provided in that valve shaft 2 is aligned axially to its stop in valve plate 1. The welded bond between valve plate 1 and valve shaft 2 is performed with this alignment.

The coordination of thrust part 3 to valve shaft 2 within the relevant sliding fit is performed by an alignment precisely fitted to the finished length of the gas shuttle valve, after which the welded bond is performed as the last processing step. For this assembling and bonding technique, it is possible, if completely finished parts are used, that no further processing has to be performed after the welding of individual parts. However, even if individual further processing and heat treatments, described in more detail in the subclaims, are necessary, in any case, length machining of the gas shuttle valve may be dispensed with after its production through the assembling and welding according to the present invention.

In particular, no further work is necessary for support 4 of the gas shuttle valve for the typical valve spring if this support is introduced precisely introduced into thrust part 3 with a predetermined distance to its free end, i.e., its bearing surface for a valve operation device, before thrust part 3 is bonded, at a precise length, to the valve shaft.

Support 4 is implemented on thrust part 3 as a simple ring shoulder. However, since this ring shoulder has a defined distance to the free end of thrust part 3, this support 4 automatically has a precisely fitted position in relation to the valve spring. A support device 5, necessary between support 4 and the valve spring (not shown) for the spring to be able to be mounted, may comprise, as is typical, an outer ring 6 and an inner ring 7, divided around the circumference, these two rings being coaxially concentric via a conical surface in such a way that they may support and fix with a precise fit under the pressure of the valve spring in support 4.

The sliding fit between thrust part 3 and tubular shaft 2 is implemented in such a way that thrust part 3 engages with a lengthwise part in the inside of shaft 2, thrust part 3 being axially displaceable inside shaft 2 to set a precisely fitted length measure of the gas shuttle valve. The welding between thrust part 3 and shaft 2 is performed with an overall length of the gas shuttle valve which is set so it is precisely fitted. Thus a precisely fitted assembling of valve shaft (2) and thrust part (3) to a predetermined length measure that is not defined before assembly, precedes the permanent bonding of these parts.

Valve plate 1 may comprise a single material, such as light metal or ceramic, or may be assembled from multiple sheet metal parts.

In this case, valve shaft 2 is particularly advantageously bonded on one side to the combustion chamber end of valve plate 1 and on the other side to the thrust part end of valve plate 1, in order to improve the rigidity of the valve plate.

What is claimed is:

1. A method of producing a gas shuttle valve of an internal combustion engine, in which a valve plate, as a sealing element, a tubular valve shaft, as a guide element, and a thrust part, which seals the end of the valve shaft opposite to the valve plate, as a stop for a valve operating element having a support for a typical valve spring, are permanently bonded to one another, wherein a precisely fitted assembling of valve shaft (2) and thrust part (3) to a predetermined length measure that is not defined before assembly, precedes the permanent bonding of these parts; and wherein at least a part of the permanent bonds are produced through welding.

2. The method according to claim 1, wherein at least individual parts of the parts to be connected to one another are finished at least using material removal.

3. The method according to claim 2, wherein exclusively parts which are finished in regard to material removing are used for the bonding.

4. The method according to claim 1, wherein after the bonding of the individual parts (1,2,3), machining is still performed exclusively in the region of the valve plate (1).

5. The method according to claim 4, wherein the machining is restricted to the valve seat region of the valve plate (1).

6. The method according to claim 1, wherein the valve plate (1) is armored in its valve seat region before the bonding.

7. The method according to claim 1, wherein the gas shuttle valve produced by bonding the individual parts is subjected to stress-relieving annealing even before subsequent processing of its seat region.

8. The method according to claim 1, wherein the heat treatments of the individual parts (1,2,3) to be bonded to one another are terminated before the assembling process.

9. The method according to claim 1, wherein exclusively completely finished parts (1,2,3) are used for the bonding.

10. The method according to claim 1, wherein the thrust part (3) is welded to the valve shaft (2) after a previously produced, still unfixed sliding fit connection of these two parts.

11. A gas shuttle valve produced according to a method of claim 1, wherein the thrust part (3) is provided with at least one ring shoulder, running coaxially to its axis, as a finished support (4) for the valve spring.

* * * * *